US006062752A

United States Patent [19]

Pierce et al.

[11] Patent Number: 6,062,752

[45] Date of Patent: May 16, 2000

[54] DEVICE AND METHOD FOR ENABLING A CONVENTIONAL PRINTER TO PRINT ON AN EDGE OF AN ENVELOPE

[75] Inventors: Jeffrey D. Pierce, Norwalk; Ronald P. Sansone; Fran E. Blackman, both of Weston; Denis J. Stemmle, Milford; Ronald Reichman, Trumbull, all of Conn.

[73] Assignee: Pitney Bowes Inc., Stamford, Conn.

[21] Appl. No.: 09/236,420

[22] Filed: Jan. 25, 1999

[51] Int. Cl.[7] ..... B41J 13/24

[52] U.S. Cl. ..... 400/622; 400/522

[58] Field of Search ..... 400/622, 623, 400/522, 523, 521, 531, 626

[56] References Cited

U.S. PATENT DOCUMENTS

| | | | |
|---|---|---|---|
| 1,274,864 | 8/1918 | Evans | 101/127.1 |
| 2,758,695 | 8/1956 | Symonds | 400/544 |
| 3,980,006 | 9/1976 | Welch | 93/61 R |
| 4,529,227 | 7/1985 | Fields | 400/531 |
| 4,598,860 | 7/1986 | Pennock | 400/622 |
| 4,598,903 | 7/1986 | Sarumaru | 400/622 |
| 4,624,408 | 11/1986 | VerMehren | 229/69 |
| 4,636,099 | 1/1987 | Goldstone | 400/622 |
| 4,708,503 | 11/1987 | Poor | 400/622 |
| 4,807,805 | 2/1989 | Rutkowski | 229/69 |
| 4,822,017 | 4/1989 | Grismyer | 271/2 |
| 4,869,485 | 9/1989 | Enix | 400/622 |
| 4,966,477 | 10/1990 | Vitale | 400/522 |
| 5,803,632 | 9/1998 | Grossman | 400/626 |

FOREIGN PATENT DOCUMENTS

| | | | |
|---|---|---|---|
| 0131277 | 7/1985 | Japan | 400/531 |
| 2092994 | 8/1982 | United Kingdom | 400/521 |

*Primary Examiner*—John S. Hilten
*Assistant Examiner*—Anthony H. Nguyen
*Attorney, Agent, or Firm*—Michael E. Melton; Ronald Reichman

[57] ABSTRACT

A carrier for holding a conventional envelope in a predetermined position to enable printing near an edge of the envelope with a conventional printer is disclosed. The carrier includes a sheet-like substrate having a leading edge, a trailing edge, a closure flap receiving slot between the leading and trailing edges, and means for holding at least a portion of a bottom edge of the envelope to the substrate. A method according to the present invention includes the steps of providing an envelope, providing a carrier for holding the envelope in a predetermined position, and providing a conventional printer. A closure flap of the envelope is inserted through a closure flap receiving slot in the carrier. Next, a bottom edge of the envelope is held against the carrier. Then, the carrier and the envelope are passed through the conventional printer, which prints on the envelope.

17 Claims, 4 Drawing Sheets

DEVICE AND METHOD FOR ENABLING A CONVENTIONAL PRINTER TO PRINT ON AN EDGE OF AN ENVELOPE

TECHNICAL FIELD

The present invention relates generally to a device and method for holding an envelope in a predetermined position suitable for printing on the envelope. More specifically, the present invention relates to a carrier and method for holding an envelope so as to permit printing near an edge of the envelope with a conventional printer.

BACKGROUND OF THE INVENTION

It is known in the prior art to use a carrier to convey envelopes through printing devices. Generally, conventional paper envelopes are attached to a paper carrier sheet with spots of adhesive adjacent to the outer edge of the envelope sealing flap and adjacent to the upper edge of the envelope back panel. An example of such a carrier sheet can be found in U.S. Pat. No. 3,980,006.

Such prior art carrier sheets require special machines to properly position and secure the envelopes to the carrier sheet. Furthermore, another special machine is required to remove the envelopes from the carrier sheet. Consequently, such carrier sheets are not appropriate for use by a low volume mailer, as, for example, many users of personal computers.

In the near future, the United States Post Office may permit application of postage directly on an envelope by a personal computer printer. See the specification issued by the U.S. Postal Service entitled Information Based Indicia Program Postal Security Device Specification ("IBIPPSDS"), dated Jun. 13, 1996. The IBIPPSDS includes proposed specifications for the new information based indicia ("IBI"). The IBI will include a two-dimensional bar code containing hundreds of bytes of information about the mail piece and certain human-readable information. Current U.S. Postal Service IBI specifications require a facing identification mark ("FIM") to be part of the IBI. In the United States, a FIM is a pattern printed in the upper right portion of the envelope adjacent to its top edge. Personal computer systems have difficulty in properly printing the FIM because U.S. Post Office Regulations require precise placement of the FIM near the top edge of the envelope, and the software which controls the printer typically does not permit printing close enough to the edge of the envelope to satisfy the specifications.

Another problem with using a conventional printer to print on an envelope is that such printers have a tendency to cause the glue on the envelope closure flap to adhere to the body of the envelope, thereby sealing or partially sealing the envelope and potentially rendering the envelope useless. Such adhesion is caused by the fact that the closure flap is closed over the body such that the glue contacts the body of the envelope during printing. Heat from the printer causes moisture in the paper to evaporate and moisten the glue which then adheres to the envelope body.

SUMMARY OF THE INVENTION

Accordingly, it is an object of the present invention to provide a carrier which permits quick and easy positioning of the envelope on the carrier without the use of special tools or machines.

In addition, it is an object of the present invention to provide a carrier which permits quick and easy removal of the envelope from the carrier without the use of special tools or machines.

Furthermore, it is an object of the present invention to provide means by which a conventional personal computer printer can print a FIM on an edge of an envelope.

It is a further object of the present invention to provide means for printing on an envelope with a conventional printer, which reduces the tendency of the glue on the closure flap to adhere to the body of the envelope during printing.

The foregoing objectives are realized by the present invention which is a carrier for holding a conventional envelope, having a top edge, a closure flap attached to its top edge and a bottom edge, in a predetermined position for printing near an edge of the envelope with a conventional printer. The carrier is formed by a sheet-like substrate having a leading edge, a trailing edge, a closure flap receiving slot between the leading and trailing edges, and means for holding at least a portion of the bottom edge of the envelope to the substrate.

The foregoing objectives are also realized by a method for printing near an edge of a conventional envelope using a conventional personal computer printer. The method includes the steps of providing an envelope having a top edge, a closure flap attached to its top edge and a bottom edge, providing a carrier for holding the envelope in a predetermined position, the carrier being formed by a sheet-like substrate having a leading edge, a trailing edge, a closure flap receiving slot between the leading and trailing edges, and means for holding at least a portion of the bottom edge of the envelope to the substrate, and by providing a conventional printer. The closure flap of the envelope is inserted through the closure flap receiving slot in the carrier. Next, the bottom edge of the envelope is held against the carrier. Then, the carrier and the envelope are passed through the conventional printer, which prints on the envelope.

Other objects and advantages of the present invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which.

DETAILED DESCRIPTION

Figure 1:
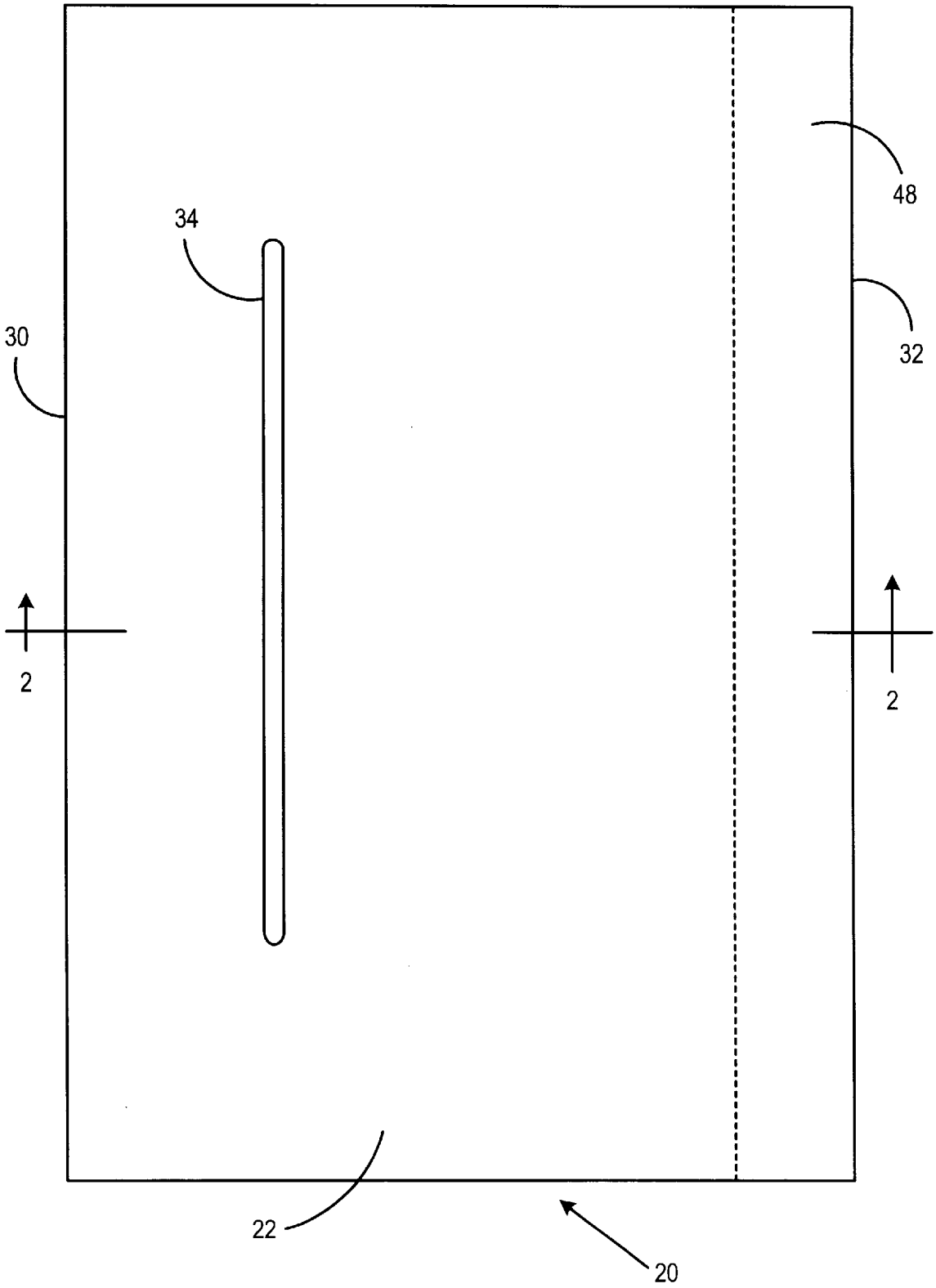
FIG. 1 is a plan view of the carrier of the present invention.
Figure 2:
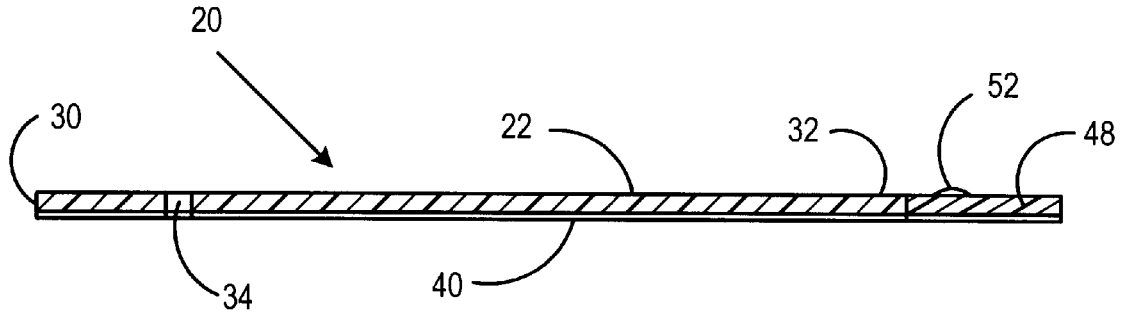
FIG. 2 is a cross sectional view of the carrier of the present invention taken along the line 2—2 in FIG. 1.
Figure 3:
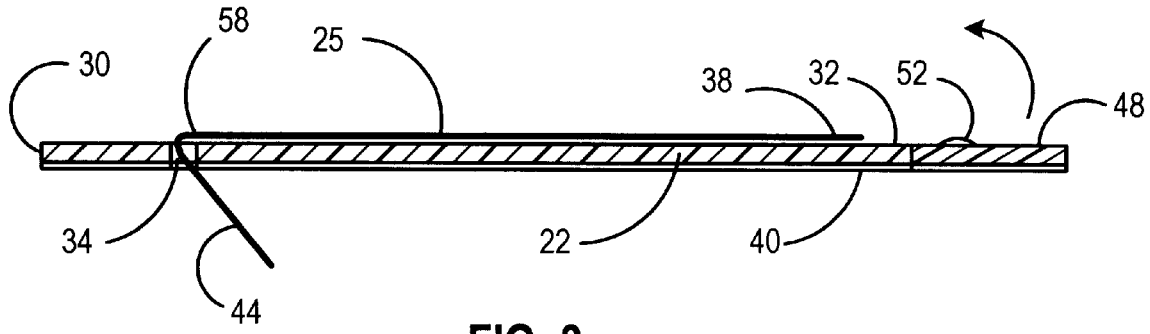
FIG. 3 is a cross sectional view of the carrier of the present invention as shown in FIG. 2 showing an envelope placed thereon with its closure flap inserted through the closure flap receiving slot.
Figure 4:
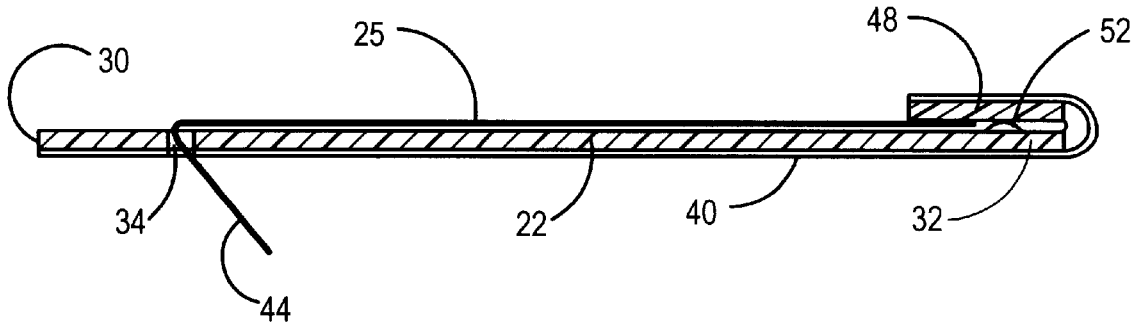
FIG. 4 is a cross sectional view of a carrier of the present invention with an envelope placed thereon and a substrate flap folded over the bottom edge of the envelope.

FIGS. 1–4 depict a first embodiment of a carrier for holding a conventional envelope 25 in a predetermined position for printing on its surface, including an edge. As shown in FIGS. 1–4, the carrier 20 is formed by a sheet-like substrate 22 having a leading edge 30, a trailing edge 32, and a closure flap receiving slot 34 between the leading 30 and trailing 32 edges. A substrate flap 48 is attached to the substrate 22 at the trailing edge 32. As shown in FIG. 4, the substrate flap 48 holds at least a portion of the bottom edge 38 of the envelope 25 between the substrate flap 48 and the substrate 22. The substrate flap 48 may be secured to the substrate 22 by an adhesive 52 located at edges of the substrate flap 48 to provide a more secure means of holding the bottom edge 38 of the envelope 25. The adhesive 52 may be a pressure sensitive adhesive.

Figure 5:
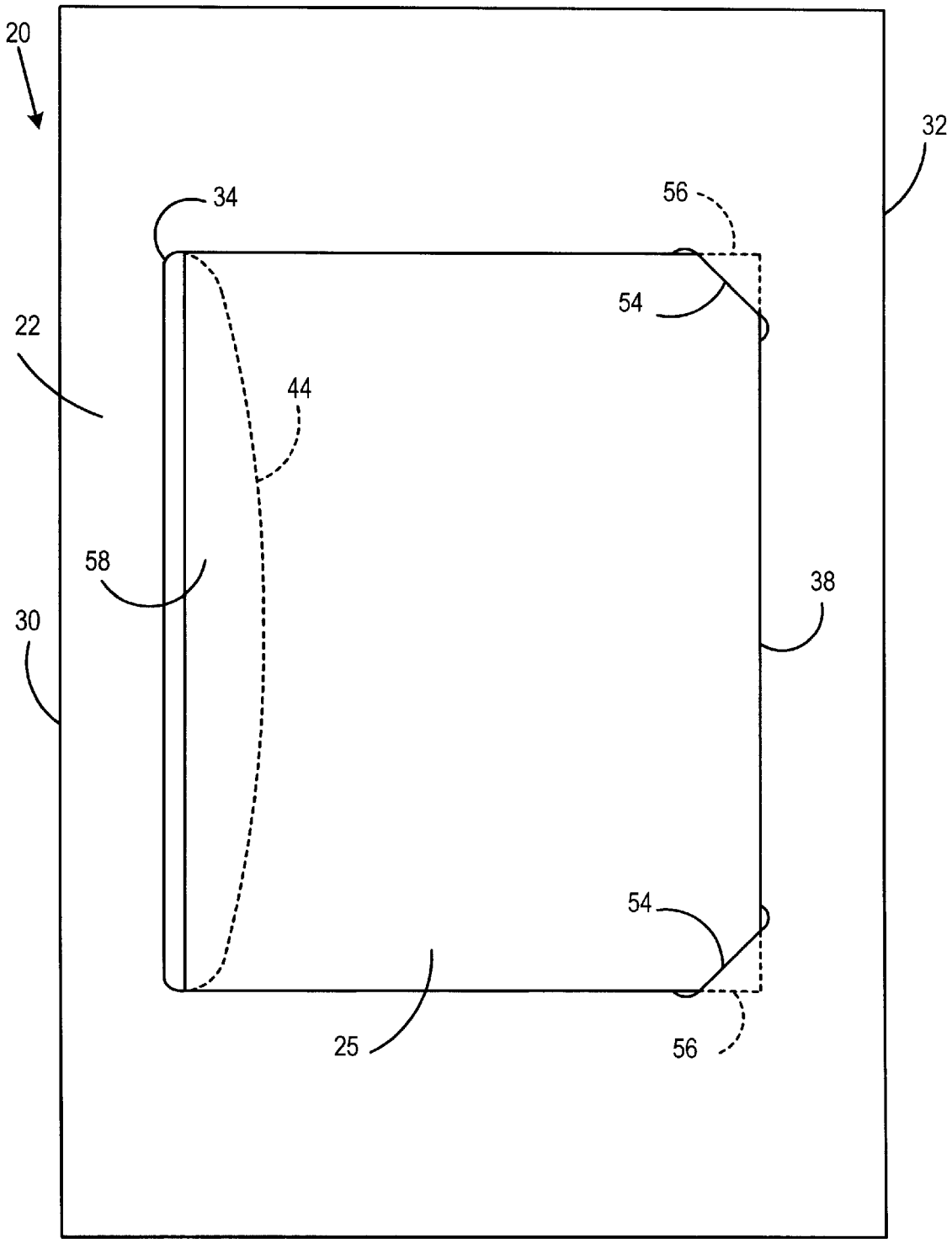
FIG. 5 is a plan view of the carrier of the present invention with an envelope placed thereon having its bottom corners inserted through slots in the carrier.

Alternatively, as shown in FIG. 5, in lieu of the substrate flap 48, one or more bottom-edge slots 54 positioned on the substrate 22 between the closure flap receiving slot 34 and the trailing edge 32 hold at least a portion of the bottom edge 38. The bottom-edge slots 54 may be positioned so as to hold one or more corners 56 of the envelope 25 bordering the bottom edge 38. In lieu of, or in addition to, a substrate flap 48 or the bottom-edge slots 54, adhesive may be applied to the substrate 22 to adhere a portion of the envelope 25 near its bottom edge 38 to the substrate 22. The adhesive may be a pressure sensitive adhesive.

The sheet-like substrate 22 is preferably formed by a heat resistant material, such as polyester, whose physical properties are not substantially altered by exposure to heat typically encountered in a conventional printer, such as a laser printer. In an alternative embodiment, the substrate 22 is coated with a coating material 40 such as tetrafluoroethylene, which prevents the typical glue found on the closure flap 44 from sticking to the substrate 22. The coating material 40 may partially coat the substrate 22 in the vicinity where the envelope closure flap 44 potentially contacts the substrate 22, or, as shown in FIGS. 2–4, the coating material 40 may entirely coat the substrate 22 to provide a uniform surface.

Figure 6:
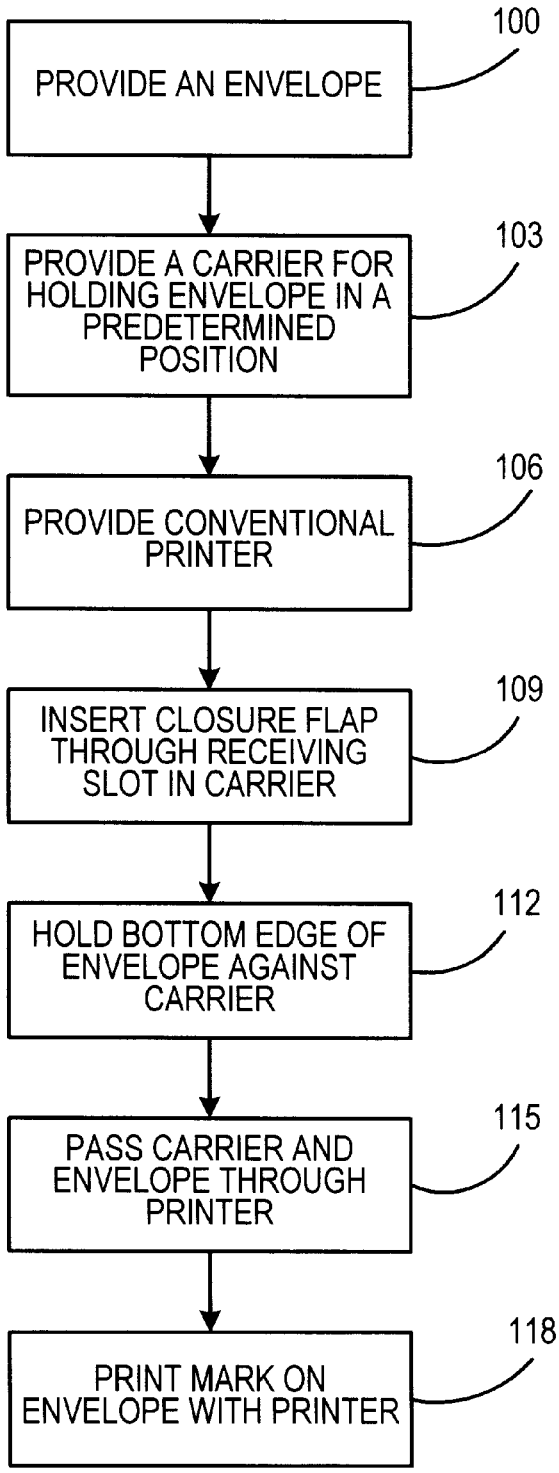
FIG. 6 is a block diagram describing the steps of a method according to the present invention.

The present invention also includes a method for printing on a conventional envelope 25 using a conventional personal computer printer, such as a laser printer, which enables the conventional printer to print near an to edge of the envelope 25. FIG. 6 shows the steps of the method and FIGS. 2–4 depict a carrier 20 which may be used in the method. In the method, a conventional envelope 25 having a top edge 58, a closure flap 44 attached to the top edge 58 and a bottom edge 38 is provided (step 100). In addition, a carrier 20 such as that described above is provided (step 103), and a conventional printer is provided (step 106). Then, the closure flap 44 of the envelope 25 is inserted (step 109) through the closure flap receiving slot 34 of the substrate 22, as shown in FIG. 3, and the bottom edge 38 of the envelope 25 is held (step 112) against the substrate 22 by the substrate flap 48 or one or both of the slots 54, depending on the configuration of the carrier 20. Finally, the carrier 20 and the envelope 25 are passed through the printer (step 115) and the printer prints (step 118) on the envelope 25.

It will be recognized by those skilled in the art that the carrier 20 of the present invention permits quick and easy positioning and removal of an envelope 25 on the carrier 20 without the use of special tools. Furthermore, the present invention provides means by which a conventional personal computer printer can print a FIM on an envelope 25 while reducing the chance that glue on the closure flap 44 will adhere to the envelope 25, or the carrier 20. Finally, the carrier 20 of the present invention does not occupy a large amount of space when not in use and can be inexpensively manufactured.

Although the present invention has been described with respect to one or more particular embodiments of the device, it will be understood that other embodiments of the present invention may be made without departing from the spirit and scope of the present invention. Hence, the present invention is deemed limited only by the appended claims and the reasonable interpretation thereof.

What is claimed is:

1. A carrier for holding a conventional envelope having a top edge, a closure flap attached to the top edge and a bottom edge, in a predetermined position for printing near the top of the envelope with a conventional printer, the carrier comprising:

a substrate in the form of a sheet, having a leading edge, a trailing edge, a closure flap receiving slot between the leading and trailing edges, wherein the receiving slot holds the top edge of the envelope to the substrate so that a conventional printer may print near the top edge of the envelope, and means for holding at least a portion of the bottom edge of the envelope to the substrate, the means for holding being locate between the closure flap receiving slot and the trailing edge.

2. The carrier of claim 1, wherein the substrate is formed of a heat resistant material whose physical properties are not substantially altered by exposure to heat from a conventional printer.

3. The carrier of claim 1, wherein the substrate is polyester.

4. The carrier of claim 1, wherein the substrate is coated with a material for preventing sticking of the closure flap to the substrate.

5. The carrier of claim 4, wherein the material for preventing sticking contains tetrafluoroethylene.

6. The carrier of claim 1, wherein the means for holding is a substrate flap attached to the substrate at the trailing edge.

7. The carrier of claim 6, wherein the substrate flap is held to the substrate by an adhesive.

8. The carrier of claim 1, wherein the means for holding is a bottom-edge slot in the substrate for holding at least a portion of the bottom edge of the envelope.

9. The carrier of claim 8, wherein the bottom-edge slot is positioned on the substrate so as to hold a corner of the envelope.

10. The carrier of claim 1, wherein the means for holding is a pair of bottom-edge slots positioned on the substrate so as to hold corners of the envelope bordering the bottom edge.

11. The carrier of claim 1, wherein the means for holding is an adhesive.

12. The carrier of claim 11, wherein the adhesive is pressure sensitive.

13. A method for printing on a conventional envelope using a conventional printer which enables the conventional printer to print near a top edge of the envelope, the method comprising the steps of:

(a) providing an envelope having a top edge, a closure flap attached to the top edge, and a bottom edge;

(b) providing a carrier for holding the envelope in a predetermined position, the carrier comprising a substrate in the form of a sheet having a leading edge, a trailing edge, and a closure flap receiving slot between the leading and trailing edges;

(c) providing a conventional printer;

(d) inserting the closure flap of the envelope through the closure flap receiving slot of the carrier;

(e) holding the bottom edge of the envelope against the carrier;

(f) passing the carrier and the envelope through the conventional printer; and (g) printing near the top edge of the envelope with the conventional printer.

14. The method of claim 13, wherein the step (e) of holding the bottom edge of the envelope includes providing an adhesive on the carrier.

15. The method of claim 13, wherein the carrier provided in step (a) includes a bottom-edge slot in the carrier for holding at least a portion of the bottom edge of the envelope, and wherein the step (e) of holding the bottom edge of the envelope is performed by placing at least a portion of the bottom edge through the bottom-edge slot.

16. The method of claim 13, wherein the carrier provided in step (a) includes a bottom-edge slot in the carrier, and the step (e) of holding the bottom edge of the envelope is performed by placing a corner of the envelope through the bottom-edge slot.

17. The method of claim 13, wherein the carrier provided in step (a) includes a substrate flap attached to the substrate at the trailing edge, and wherein the step (e) of holding the bottom edge of the envelope is performed by folding the substrate flap over the bottom edge of the envelope.

* * * * *

UNITED STATES PATENT AND TRADEMARK OFFICE

CERTIFICATE OF CORRECTION

PATENT NO. : 6,062,752
DATED : May 16, 2000
INVENTOR(S) : Jeffrey D. Pierce, et. al.

It is certified that error appears in the above-indentified patent and that said Letters Patent is hereby corrected as shown below:

Title page, item [75], after Trumbull, add --Pushavadan S. Nagarsheth, Danbury--

Signed and Sealed this

Twentieth Day of March, 2001

Nicholas P. Godici

*Attest:*

NICHOLAS P. GODICI

*Attesting Officer*

*Acting Director of the United States Patent and Trademark Office*